US011963644B1

(12) United States Patent
Savic

(10) Patent No.: US 11,963,644 B1
(45) Date of Patent: Apr. 23, 2024

(54) PORTABLE HANDWASHING DEVICE

(71) Applicant: Slobodan Savic, Binbrook (CA)

(72) Inventor: Slobodan Savic, Binbrook (CA)

( * ) Notice: Subject to any disclaimer, the term of this patent is extended or adjusted under 35 U.S.C. 154(b) by 0 days.

(21) Appl. No.: 18/300,371

(22) Filed: Apr. 13, 2023

(51) Int. Cl.
*A47K 5/12* (2006.01)
*B65D 43/02* (2006.01)

(52) U.S. Cl.
CPC ..... *A47K 5/1201* (2013.01); *B65D 43/0202* (2013.01); *B65D 2543/00194* (2013.01)

(58) Field of Classification Search
CPC ..... B65D 75/5894; B65D 75/5855; B65D 35/22; B65D 83/0805; B65D 2575/586; B65D 43/0202; B65D 2543/00194; A47K 5/1201
See application file for complete search history.

(56) References Cited

U.S. PATENT DOCUMENTS 2,970,920 A * 2/1961 Forkner ..... B65D 83/06 426/115
5,709,479 A * 1/1998 Bell ..... B65D 75/008 383/906
8,157,464 B2 * 4/2012 Prax ..... A45D 34/04 401/133
8,277,121 B2 * 10/2012 Bell ..... B65D 31/10 383/906
9,782,946 B2 * 10/2017 Huffer ..... B32B 37/12
10,589,904 B2 * 3/2020 Farstad ..... B65D 33/01

FOREIGN PATENT DOCUMENTS

KR 20110008753 U * 9/2011

* cited by examiner

*Primary Examiner* — Frederick C Nicolas
*Assistant Examiner* — Randall A Gruby
(74) *Attorney, Agent, or Firm* — Orin Del Vecchio

(57) ABSTRACT

A portable hand washing device that is configured to provide cleansing of a user's hands. The present invention includes a storage member having a first wall and a second wall secured along a perimeter edge forming an interior volume therebetween. The storage member is manufactured from a durable flexible material such as but not limited to plastic. The first wall has formed therein a discharge area that includes a plurality of apertures that are configured to allow fluid from the interior volume egress therefrom. A surfactant reservoir is formed in the first wall and is configured to store a liquid surfactant therein. A sealing member is releasably secured to the first wall and is movable from a first position to a second position. The first position of the sealing member provides a seal and coverage of the surfactant reservoir and discharge area.

5 Claims, 1 Drawing Sheet

PORTABLE HANDWASHING DEVICE

FIELD OF THE INVENTION

The present invention relates generally to hygiene products, more specifically but not by way of limitation, a portable handwashing device that is configured to receive, store and dispense water and a surfactant so as to facilitate cleaning of a user's hands.

BACKGROUND

The spread of germs and viruses results in routine transmission of colds, flus and other viruses. Some germs and viruses are spread through the air wherein an individual will inhale airborne pathogens exhaled by an infected individual that is in close proximity. Other germs, bacteria and viruses can live on surfaces for longer periods of time and if touched by an individual will be transferred to their hands. It is well established that a rigorous hand hygiene protocol is a fundamental practice to ensure good health.

Routine hand washing can be executed when individuals are either at their homes or in facilities that have bathrooms. However, when not proximate sinks and the like, routine hand hygiene becomes more challenging. While there are products that can provide sterilization of hands such as but not limited to alcohol-based gels, these products do not remove dirt or other contaminants that must be removed through use of water and surfactants.

Accordingly, there is a need for a portable hand washing device that provides cleaning of hands wherein the present invention receives, stores and dispenses water and a surfactant and wherein the present invention is manufactured from a bio-degradable material and disposable.

SUMMARY OF THE INVENTION

It is the object of the present invention to provide a portable hand washing device that is operable to facilitate cleaning of hands of a user wherein the present invention includes a storage member having a first wall and a second wall.

Another object of the present invention is to provide a hand washing device to be employed for cleaning of hands of a user wherein the storage member includes a discharge area formed in the first wall thereof.

A further object of the present invention is to provide a portable hand washing device that is operable to facilitate cleaning of hands of a user wherein the discharge area includes a plurality of apertures configured to facilitate dispensing of water.

Yet a further object of the present invention is to provide a hand washing device to be employed for cleaning of hands of a user wherein the present invention further includes a sealing member.

Still another object of the present invention is to provide a portable hand washing device that is operable to facilitate cleaning of hands of a user wherein the sealing member is releasably secured to the outer surface of the first wall of the storage member over the discharge area.

An additional object of the present invention is to provide a hand washing device to be employed for cleaning of hands of a user that further includes a surfactant reservoir formed on the outer surface of the first wall of the storage member.

Yet a further object of the present invention is to provide a portable hand washing device that is operable to facilitate cleaning of hands of a user wherein the surfactant reservoir is configured to store surfactant therein and is further covered by the sealing member when the sealing member is in its first position.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
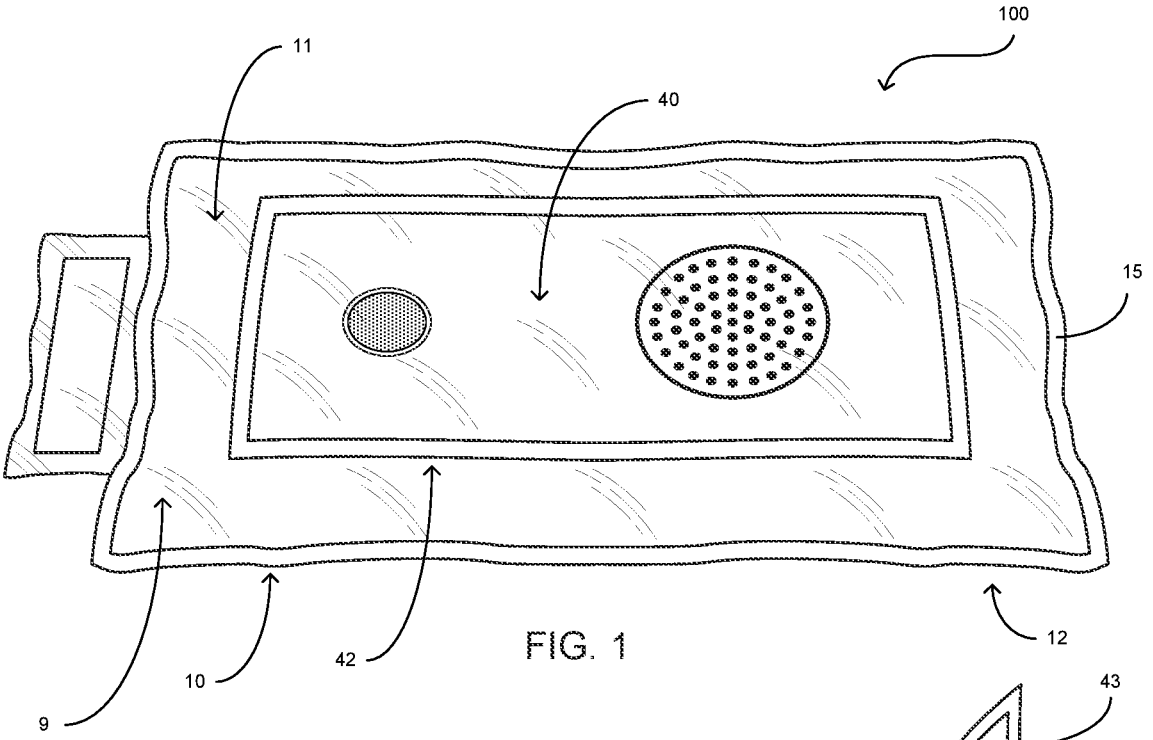
FIG. 1 is a perspective view of the present invention with the sealing member in its first position.

Referring now to the drawings submitted herewith, wherein various elements depicted therein are not necessarily drawn to scale and wherein through the views and figures like elements are referenced with identical reference numerals, there is illustrated a portable hand washing device 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to the Figures submitted herewith, the portable hand washing device 100 includes a storage member 10. The storage member 10 is manufactured from a suitable durable material such as but not limited to plastic. The storage member 10 includes a first wall 11 and a second wall 12 that are sealed together at perimeter edge 15 so as to form an interior volume. It should be understood within the scope of the present invention that the first wall 11 and second wall 12 could be sealed together at the perimeter edge 15 utilizing various suitable techniques. While it is contemplated within the scope of the present invention that the storage member 10 could be provided in alternate sizes and shapes, good results have been achieved having a storage member 10 with a length of approximately five inches and a width of approximately two and a half inches. The interior volume formed between the first wall 11 and second wall 12 is configured to receive and retain water or other similar fluid suitable for facilitating the cleansing of hands.

Formed in the first wall 11 is a discharge area 20. The discharge area 22 includes a plurality of apertures 22 that permit fluid stored in the interior volume of the storage member 10 to egress therefrom. While the discharge area 22 is annular in shape in the drawings submitted herewith, it is contemplated within the scope of the present invention that the discharge area could be provided in alternate shapes and sizes. Furthermore, it should be understood within the scope of the present invention that the discharge area 20 could be provided with alternate quantities and sizes of apertures 22.

Formed in the first wall 11 in general axial alignment with the discharge area 20 is a surfactant reservoir 30. The surfactant reservoir 30 is formed in the outer surface 9 of the first wall 11 and provides a depression to receive and retain surfactant 31. While the surfactant reservoir 30 is annular in shape in the Figures submitted as a part hereof, it is contemplated within the scope of the present invention that the surfactant reservoir 30 could be provided in alternate shapes and sizes. Furthermore, it is contemplated within the scope of the present invention that the surfactant reservoir 30 could be provided in alternate locations in addition to the location illustrated and described herein. In a preferred embodiment of the present invention, the surfactant 31 disposed in the surfactant reservoir 30 is a liquid surfactant.

Figure 2:
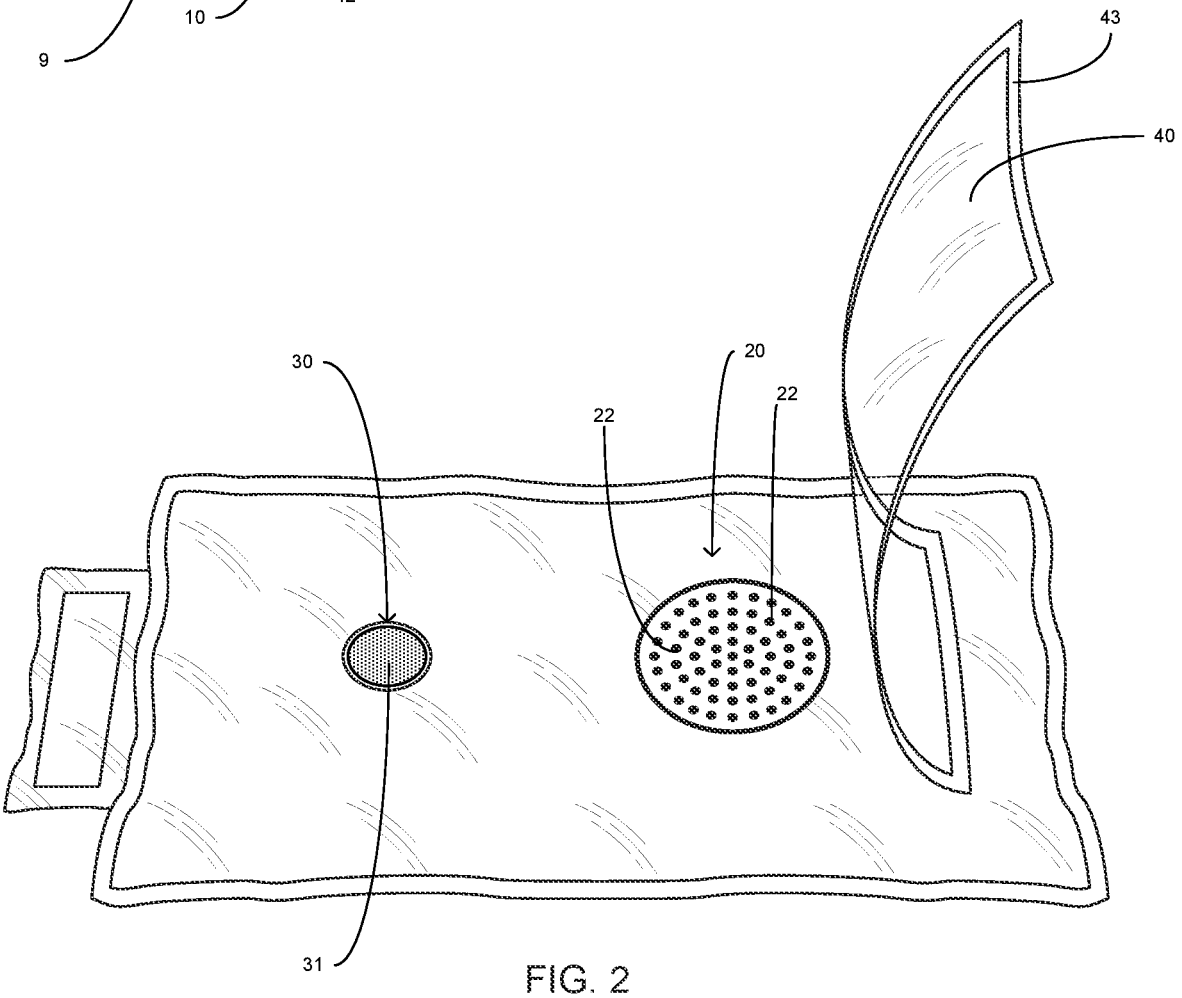
FIG. 2 is a perspective view of the present invention with the sealing member in its second position.

Releasably secured to the first wall 11 is the sealing member 40. The sealing member 40 is manufactured from a durable flexible material such as but not limited to plastic. The sealing member 40 is rectangular in shape and includes a perimeter edge 42 having a sealing element 43 that is operable to releasably secure the sealing member 40 on the outer surface 9 of the first wall 11. The sealing member 40 is provided in a size so as to superposed the first wall 11 in order to cover and seal both the discharge area 20 and the surfactant reservoir 30. As is illustrated herein in FIG. 1 submitted herewith, in the first position the sealing member 40 is adjacent the outer surface 9 of the first wall and secured thereto so as to inhibit access to the surfactant 31 and the discharge area 20. FIG. 2 submitted herewith illustrates the sealing member 40 in its second position wherein the sealing member 40 has been removed from covering the surfactant reservoir 30 and the discharge area 20 in order to facilitate access to the surfactant 31 and allow water stored in the interior volume of the storage member 10 to egress from the apertures 22 of the discharge area 20 in order to provide cleansing of the hands of a user. It should be understood within the scope of the present invention that the surfactant could be disposed between the sealing member 40 and the outer surface 9 of the first wall 11 without the need for a surfactant reservoir 30.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A portable hand washing device comprising:

a storage member, said storage member having a first wall and a second wall, said first wall and said second wall sealed along a perimeter edge to create an interior volume, said interior volume configured to receive and retain a fluid therein;

a discharge area, said discharge area being formed in said first wall of said storage member, said discharge area having a plurality of apertures, said discharge area configured to permit the fluid to egress outward from the interior volume of the storage area;

a sealing member, said sealing member being superposed on an outer surface of said first wall, said sealing member having a perimeter edge, said sealing member being secured to the outer surface of said first wall along the perimeter edge of said sealing member, said sealing member having a first position and a second position; and, a surfactant reservoir, said surfactant reservoir formed in the outer surface of the first wall, said surfactant reservoir configure to receive and retain a surfactant therein, said surfactant reservoir being covered by said sealing member in the first position of the sealing member, wherein the surfactant reservoir is a depression in the first wall.

2. The portable hand washing device as recited in claim 1, wherein in said second position said sealing member is removed from said surfactant reservoir and said discharge area.

3. The portable hand washing device as recited in claim 2, wherein the storage member is rectangular in shape.

4. The portable hand washing device as recited in claim 3, wherein said storage member is approximately five inches in length and two inches in width.

5. The portable hand washing device as recited in claim 4, wherein said discharge area is annular in shape.

* * * * *